US007325466B2

(12) United States Patent
Allegretti et al.

(10) Patent No.: US 7,325,466 B2
(45) Date of Patent: Feb. 5, 2008

(54) MANIPULATOR WITH ELECTROMAGNETIC DETENT FOR THE DRIVING SERVO-CONTROL OF HYDRAULIC MECHANISMS

(75) Inventors: Mirco Allegretti, Reggio Emilia (IT); Felice Di Vico, Carpi (IT)

(73) Assignee: Walvoil S.p.A., Reggio Emilia (IT)

( * ) Notice: Subject to any disclaimer, the term of this patent is extended or adjusted under 35 U.S.C. 154(b) by 761 days.

(21) Appl. No.: 10/874,311

(22) Filed: Jun. 24, 2004

(65) Prior Publication Data

US 2005/0005978 A1 Jan. 13, 2005

(30) Foreign Application Priority Data

Jul. 9, 2003 (IT) ..... PR2003A0051

(51) Int. Cl.
*F15B 13/02* (2006.01)

(52) U.S. Cl. ..... 74/471 XY; 74/527; 74/532; 137/636.2

(58) Field of Classification Search ..... 74/471 XY, 74/473.23, 527, 532; 137/636.2
See application file for complete search history.

(56) References Cited

U.S. PATENT DOCUMENTS 4,777,981 A * 10/1988 Petro ..... 137/636.2
4,827,982 A * 5/1989 Inagaki ..... 137/636.1
5,566,710 A * 10/1996 Dahlgren et al. ..... 137/556

* cited by examiner

*Primary Examiner*—William C. Joyce
(74) *Attorney, Agent, or Firm*—Young & Thompson

(57) ABSTRACT

A servo control device for driving hydraulic equipment with electromagnetic coupling, and more precisely it refers to a manipulator with detent to lock the system in particular positions in order to allow its continuous operation, with possible actions on pushers next to the one pressed with active coupling. The detent is composed of an electromagnet (8) integral with the shaft (3) of the manipulator (2) connected through a joint (6) to the servo-control body and of a coupling plate (9) secured to the servo-control body by a peg or joint (10) whose axis (13) is coaxial with the joint axis (11).

4 Claims, 2 Drawing Sheets

MANIPULATOR WITH ELECTROMAGNETIC DETENT FOR THE DRIVING SERVO-CONTROL OF HYDRAULIC MECHANISMS

BACKGROUND OF THE INVENTION

The present invention deals with a manipulator with electromagnetic detent for the driving servo-control of hydraulic mechanisms.

Function of electromagnetic detents is locking the driving servo-control in particular positions in order to allow the continuous operation without the operator acting on the manipulator handle or joystick for the whole execution time. Object of the present invention is adding a possible action on pushers next to the one pressed with active coupling, allowing a manipulator rotation that is orthogonal to the one allowing its locking. The introduction of this movement has required an improvement of kinematism efficiency in order to avoid relative movements between plate and coupling device, to remove rubbing phenomena between these two components and reducing the contact wear.

Manipulators are already known that are equipped with electromagnetic detents, such as the one disclosed in U.S. Pat. No. 4,827,982, that provide an electromagnet or a solenoid in a fixed position integral with the driving valve case and a ferromagnetic plate integral with the manipulator lever.

This type of solution does not allow the above-described crossed movement, further pointing out different problems related to the positioning of various kinematism components, especially when this construction system is applied to servo-controls with more that two controlled axes. In fact, while in this latter case the alignment between plate and solenoid is guaranteed by the kinematism structure, in the case with four controlled axes there are two orthogonal rotations usually due to a universal joint or a ball joint.

This implies a possible misalignment of the plate with respect to the solenoid, with coupling accuracy problems.

Also in the arrangement disclosed in U.S. Pat. No. 4,777,981, for every position, an electromagnet or solenoid is provided, that is supported by a plate that can vertically translate in contrast with a spring action. In the electromagnet centre, a tooth is provided that is adapted to be inserted into a notch obtained in a plate hinged to the joystick control rod.

This arrangement ensures the coupling position, but the wear problem has not yet been solved; instead, this latter problem has been made more pronounced due to the rubbing action of the tooth onto the plate.

A manipulator is also known that is described in EP 1047985 with a plate secured to a cam that is able to be actuated by the manipulator control rod, in order to be able to rotate around a shaft whose axis is placed on a plane defined by the servo-control body axis and the axis on which the servo-control signal generator moving member is arranged.

In said manipulator, guiding means are provided that are composed of a curvilinear track that is integral with the servo-control body on which a slider can slide, such slider being integral with the shaft around which the ferromagnetic plate can rotate.

The electromagnet is secured to the servo-control body.

An arrangement is also provided in which the electromagnet is secured to the shaft supported by the cam and the plate is in a fixed position.

This solution allows the simultaneous movement of nearby actuators upon coupling, optimally solving the sliding, and therefore wear, problem between electromagnet and plate, but it transfers said phenomenon between slider and track, in addition to be of a cumbersome and encumbrant construction.

BRIEF SUMMARY OF THE INVENTION

Object of the present invention is removing the above inconveniences, providing an extremely simple manipulator in which there are no wear members in the electromagnetic detent composed of plate and electromagnet or coil.

These and other objects are fully obtained by the manipulator with electromagnetic detent for driving servo-controls of hydraulic mechanisms, subject of the present invention, that is characterised in what is included in the below attached claims and in particular in that each one of the coupling plates is supported by the servo-control body in order to be able to rotate around an horizontal axis that is coaxial with the joint axis (orthogonal to the rotation axis that allows the coupling) that connects manipulator to servo-control body.

These and other features will be better pointed out by the following description of a preferred embodiment shown, merely as a non-limiting example, in the attached tables of drawing, in which:

BREIF DESCRIPTION OF THE DRAWINGS

FIG. 1.A shows in a front section the manipulator in its rest position;

FIG. 1.B shows in a front section the manipulator in its coupling position;

DETAILED DESCRIPTION OF THE PREFERRED EMBODIMENT

Figure 1A:
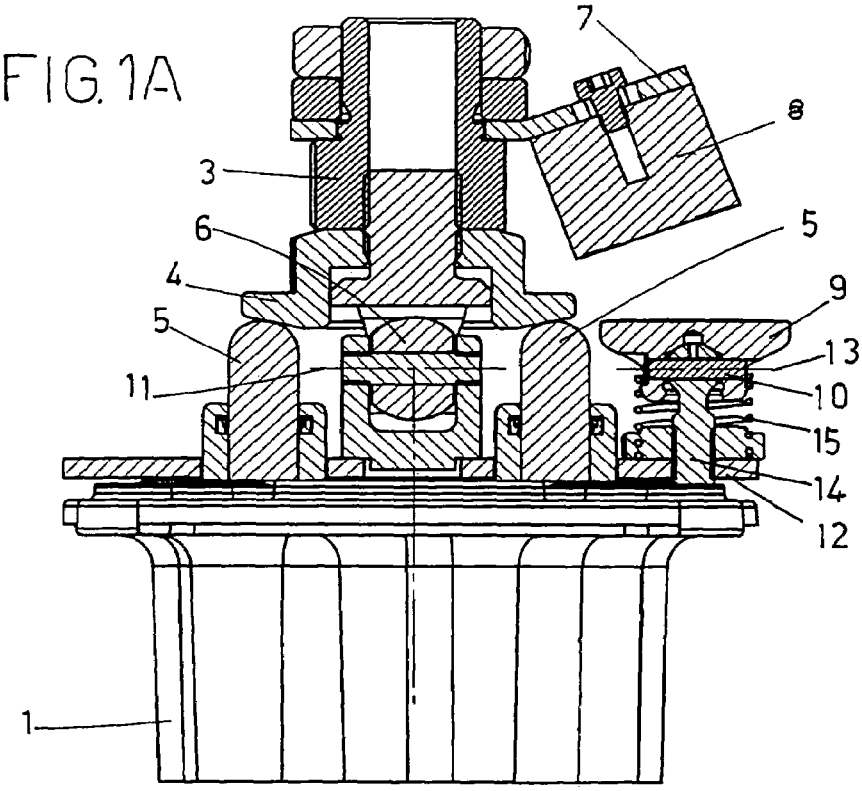

With reference to the figures, 1 designates the body of a servo-control comprising mechanisms of a known type that are not described herein below.

A manipulator 2 is applied to the servo-control and is connected to a shaft 3 that has on its lower part a plate 4 adapted to operate on one of the servo-control actuators 5 (generally four).

The shaft 3 can assume any slant, being connected to the body 1 through a universal joint 6.

A slanted bracket 7 is secured to the shaft 3 that supports a coil or electromagnet 8.

9 designates a coupling plate that can be found on the coil trajectory when this latter one is moved due to the manipulator rotation.

The coupling plate 9 is secured through a peg 10 to a vertical rod 14 that is sliding and can be blocked in a bracket 12 of the body 1 after such a calibration adjustment that the axis 13 of the peg 10 is coaxial with the axis 11 of the universal joint 6.

The plate is pushed upwards by a spring 15 to always ensure a correct parallelism of the plate 9 surface with the coil or electromagnet 8 surface.

Obviously, numerous modifications and variations, all falling within the scope of the below-listed claims, could be provided; for example, the coupling plate position could be reversed with the electromagnet position, namely coupling plate secured to manipulator shaft 3 and coil secured to servo-control body 1, though keeping the above rotation axes 11 and 13 coaxial.

The kinematism motion is a merely rotary motion, independent from its slanting, around axis 11 of the universal joint 6, while the motion of the coupling plate 9, following the peg insertion, is constrained to be merely rotating around axis 13.

Figure 1B:
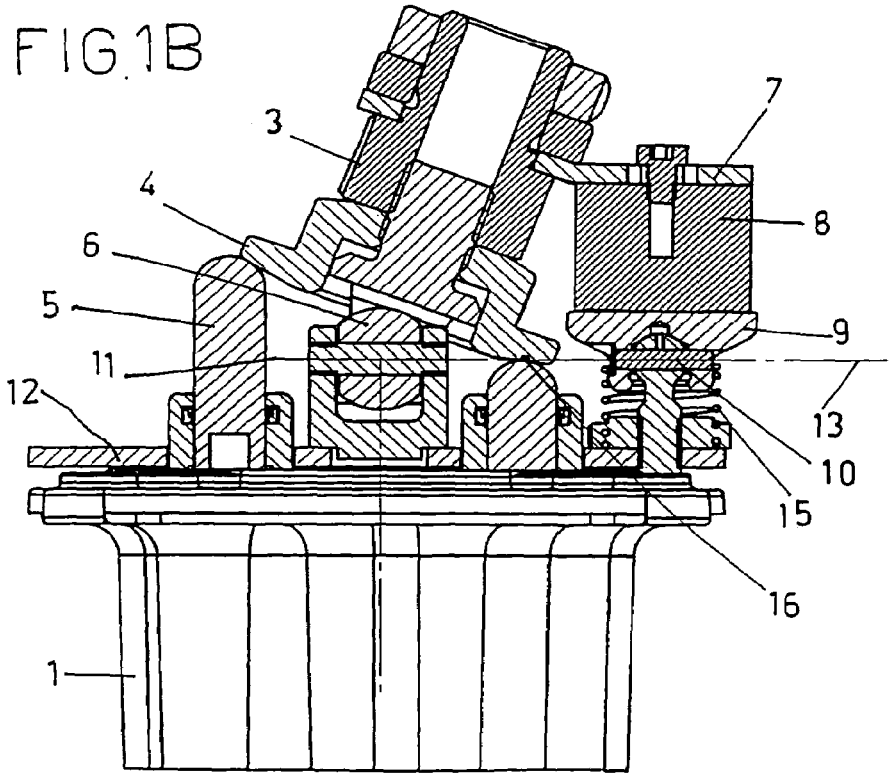
Figure 4:
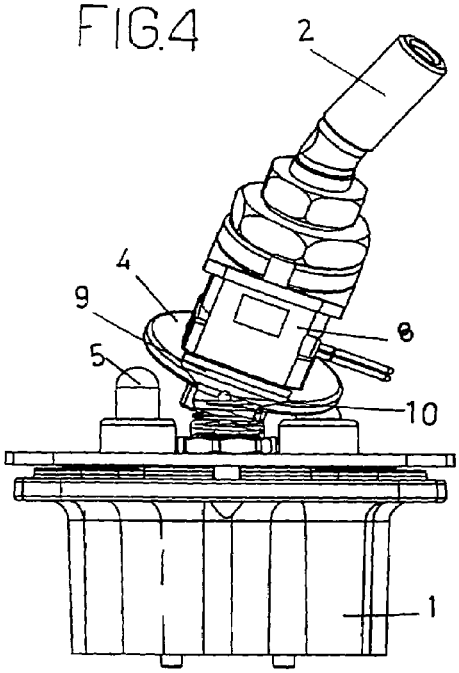
FIG. 4 shows the manipulator in a side perspective view.
Figure 2:
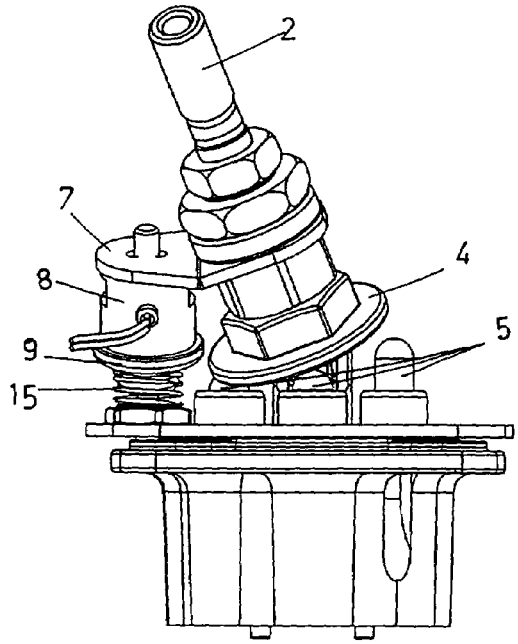
FIG. 2 shows the manipulator in a front perspective view with coupled plate.
Figure 3:
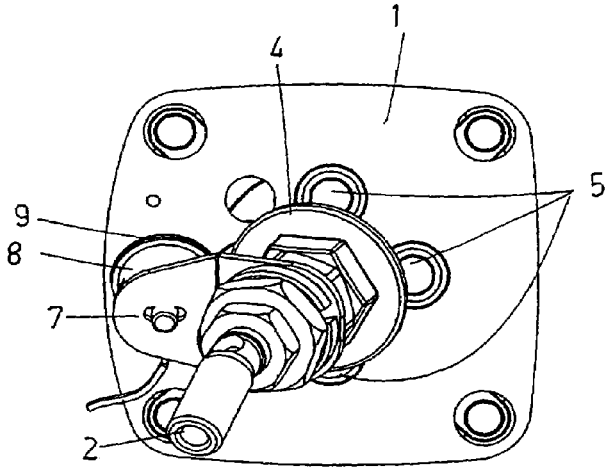
FIG. 3 shows the manipulator in a top perspective view in the same position of FIG. 2.

With this particular configuration, by imposing the same height to the two rotation axes 11 and 13, a rigid motion will be created when coupling, composed of the rotation of coupling plate and manipulator handle around a single axis, that will be the coincidence of axes 11 and 13. In this way, it will be possible to operate on the two pushers that are next to the already pressed one following the coupling, without a relative (rubbing) motion between coupling plate 9 and coil or electromagnet 8. In order to reduce the extra pusher stroke during the crossed motion upon coupling, it has been provided, as pointed out in FIG. 1.B, to place the contact point 16 between pusher 5 and plate 4, on the above described rotation axis, consequently minimising the vertical movement of the pusher being pressed when coupling.

In order to guarantee that axis 11 and axis 13 are coaxial, it is absolutely necessary to place the joint axis in such a way as to guarantee a free rotation around an axis that necessarily coincides with axis 13.

According to a possible variation, not shown, both universal joint 6 and peg 10 could be replaced by joints, for example of the ball type, that guarantee as well that the above axes are coaxial.

While with the universal type of joint only the positioning of two coupling plates is possible, with a ball joint it is possible to position four coupling plates.

The invention claimed is:

1. Manipulator with electromagnetic detent for driving servo-control of hydraulic mechanisms, comprising a shaft (3) integral with the manipulator and connected to a servo-control body (1) through a joint, said shaft supporting one or more electromagnets (8) or one or more coupling plates (9) while the servo-control body supports a corresponding number of coupling plates or electromagnets, characterised in that each one of the coupling plates (9) or each electromagnet (8) supported by the servo-control body is hinged around a horizontal axis (13) that is coaxial with the joint rotation axis (11), in order to make it possible to operate on pushers nearby the pressed pusher with active coupling, allowing a manipulator rotation that is orthogonal to the one that allows locking.

2. Manipulator according to claim 1, characterised in that each coupling plate (9) or electromagnet (8) supported by the servo-control body (1) is hinged on an horizontal pin or peg (10) that is coaxial with one of the rotation axes of an universal joint (6), said coupling plates being two at a maximum.

3. Manipulator according to claim 1, characterised in that the connection joint of manipulator shaft to servo-control body is a ball joint, the number of coupling plates being four at a maximum.

4. Manipulator according to claim 1, characterised in that each coupling plate is supported by the servo-control body through a ball joint.

* * * * *